US012624630B2

(12) United States Patent
He et al.

(10) Patent No.: US 12,624,630 B2
(45) Date of Patent: May 12, 2026

(54) LONG-TERM MONITORING APPARATUS AND METHOD FOR SURROUNDING ROCK FRACTURE EVOLUTION PROCESS TRIGGERED BY MULTIPLE-SOURCE DYNAMIC DISTURBANCES

(71) Applicant: Northeastern University, Shenyang City (CN)

(72) Inventors: Benguo He, Shenyang City (CN); Xiangrui Meng, Shenyang City (CN); Xiating Feng, Shenyang City (CN); Jie Wang, Shenyang City (CN); Hongpu Li, Shenyang City (CN); Hengyuan Zhang, Shenyang City (CN)

(73) Assignee: NORTHEASTERN UNIVERSITY, Shenyang City (CN)

( * ) Notice: Subject to any disclaimer, the term of this patent is extended or adjusted under 35 U.S.C. 154(b) by 0 days.

(21) Appl. No.: 19/131,453

(22) PCT Filed: Apr. 10, 2025

(86) PCT No.: PCT/CN2025/088258
§ 371 (c)(1),
(2) Date: May 20, 2025

(87) PCT Pub. No.: WO2026/056257
PCT Pub. Date: Mar. 19, 2026

(65) Prior Publication Data

US 2026/0078665 A1 Mar. 19, 2026

(30) Foreign Application Priority Data

Sep. 14, 2024 (CN) ..... 202411287554.4

(51) Int. Cl.
*E21B 47/002* (2012.01)
*E21B 23/00* (2006.01)

(52) U.S. Cl.
CPC ..... *E21B 47/0025* (2020.05); *E21B 23/001* (2020.05)

(58) Field of Classification Search
CPC ..... E21B 23/001; E21B 47/0224; E21B 47/0025; E21B 49/00; E21B 49/006
See application file for complete search history.

(56) References Cited

U.S. PATENT DOCUMENTS

2014/0116726 A1* 5/2014 Airey ..... E21B 23/01 166/381
2019/0064388 A1 2/2019 Mickael
(Continued)

FOREIGN PATENT DOCUMENTS

CN 102506799 A 6/2012
CN 108412480 A 8/2018
(Continued)

*Primary Examiner* — Robert E Fuller
(74) *Attorney, Agent, or Firm* — MUNCY, GEISSLER, OLDS & LOWE, P.C.

(57) ABSTRACT

Provided are a long-term monitoring apparatus and method for surrounding rock fracture evolution process triggered by multiple-source dynamic disturbances. The apparatus includes a machine body framework, a borehole wall surrounding rock image acquisition module, a borehole wall multiple-source vibration monitoring module, an in-borehole walking module, and a monitoring signal storage and transmission module. The borehole wall surrounding rock image acquisition module, the borehole wall multiple-source vibration monitoring module, the in-borehole walking module, and the monitoring signal storage and transmission module are sequentially arranged on the machine body framework from front to back. The monitoring signal storage and transmission module is connected in a communicative manner to a computer outside a borehole. The present invention can achieve integrated monitoring of imaging and vibration within a borehole. Also, the present invention can
(Continued)

achieve long-term continuous monitoring of the fracture evolution process of surrounding rock in risk regions.

4 Claims, 1 Drawing Sheet

(56) References Cited

U.S. PATENT DOCUMENTS

| | | | | |
|---|---|---|---|---|
| 2022/0049561 | A1* | 2/2022 | Saeed | E21B 49/00 |
| 2022/0171403 | A1* | 6/2022 | Dong | F16L 55/28 |
| 2023/0128181 | A1* | 4/2023 | McCormick | E21B 47/00<br>73/152.54 |

FOREIGN PATENT DOCUMENTS

| | | | | | |
|---|---|---|---|---|---|
| CN | 116088046 | A | | 5/2023 | |
| CN | 116557074 | A | | 8/2023 | |
| CN | 116575854 | A | | 8/2023 | |
| CN | 116626045 | A | | 8/2023 | |
| CN | 116892364 | A | | 10/2023 | |
| CN | 116892888 | A | | 10/2023 | |
| CN | 118309417 | A | | 7/2024 | |
| CN | 118794519 | A | | 10/2024 | |
| CN | 118794519 | B | * | 12/2024 | E21B 47/26 |

* cited by examiner

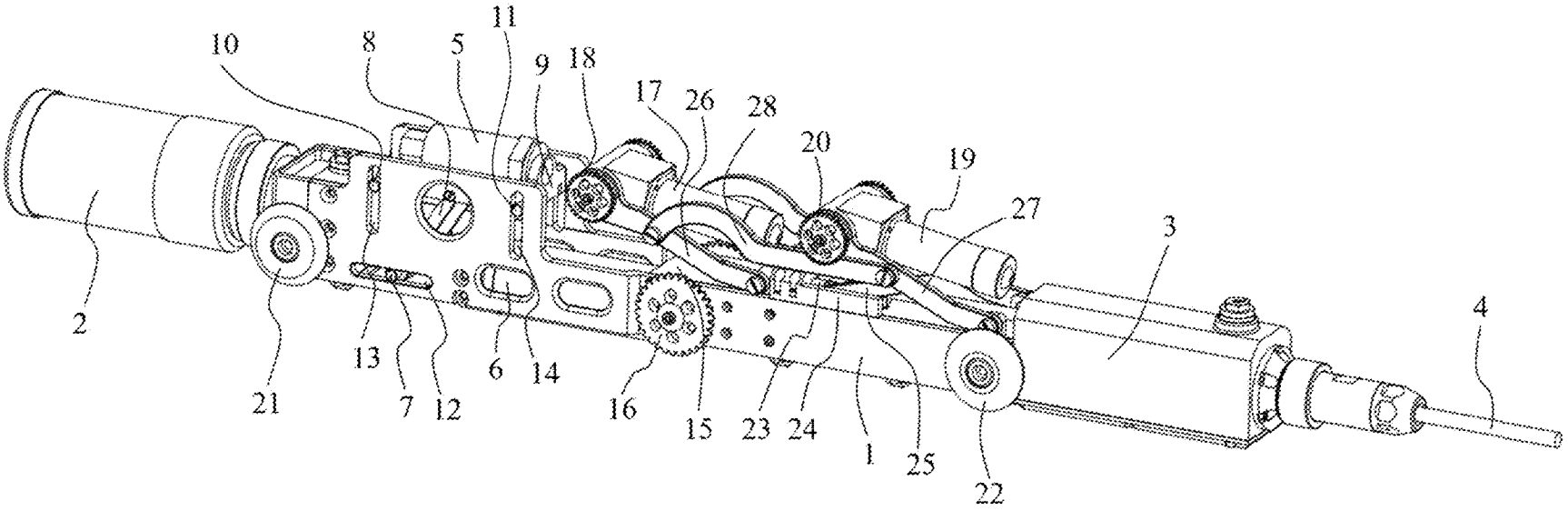
4
3
27
19
20
28
26
17
18
9
11
5
8
10
2
22
25
1
24
23
15
16
14
6
12
7
13
21

LONG-TERM MONITORING APPARATUS AND METHOD FOR SURROUNDING ROCK FRACTURE EVOLUTION PROCESS TRIGGERED BY MULTIPLE-SOURCE DYNAMIC DISTURBANCES

FIELD OF THE INVENTION

The present invention relates to the technical field of deep engineering monitoring, and particularly relates to a long-term monitoring apparatus and method for a surrounding rock fracture evolution process triggered by multiple-source dynamic disturbances.

THE PRIOR ARTS

During the construction process of deep engineering, the excavation of tunnels in seismic zones is affected by multiple-source dynamic disturbances such as seismic waves generated by strong earthquakes, continuous vibrations generated by TBM tunnel excavation, blasting vibrations generated for performing drilling and blasting methods, and stress waves from nearby rock bursts, causing long-term disturbance effects on the surrounding rock of deep engineering. It is difficult to monitor and evaluate the fracture damage inside the surrounding rock due to dynamic disturbances.

After the excavation of deep engineering, the tangential stress around the tunnel increases exponentially, and the radial stress decreases sharply, leaving the surrounding rock in an unfavorable stress state. Multiple-source dynamic disturbances can induce rock mass cracking, continuous accumulation of cracks, continuous decline in bearing capacity, and even induce time-lag rock bursts. Field statistics show that the vast majority of time-lag rock bursts are strong or extremely strong, with huge hazards, easily causing serious casualties and equipment damage. Currently, the prediction of time-lag rock bursts is mostly based on lithology and engineering geological conditions, ignoring the inducing factors of dynamic disturbances.

It is difficult to monitor the internal vibrations of deep surrounding rock, and it is challenging to measure stress waves on-site. A vibration sensor can only measure the vibration data on the surface of the surrounding rock. How to perceive the three-dimensional stress wave frequency and amplitude characteristics inside the surrounding rock has become a technical bottleneck.

Currently, the coupling between the vibration sensor and surrounding rock is generally achieved by solidifying gypsum powder with water. This coupling method, during strong earthquakes, is likely to cause local detachment between the vibration sensor and the detection surface of the surrounding rock due to intense vibrations, leading to poor or inaccurate detection results. After the vibration test is completed, it is difficult to disassemble the vibration sensor, and the gypsum powder attached to the surface of the vibration sensor probe is difficult to clean, affecting the subsequent use of the vibration sensor.

SUMMARY OF THE INVENTION

Given the problems existing in the prior art, the present invention provides a long-term monitoring apparatus and method for a surrounding rock fracture evolution process triggered by multiple-source dynamic disturbances, which can achieve integrated monitoring of imaging and vibration within a borehole. During vibration monitoring, the coupling and decoupling of the sensor and the surrounding rock are realized through a mechanical lifting manner, so as to achieve the monitoring of the surrounding rock state before and after the dynamic disturbance waves. This is conducive to identifying the initiation, expansion, and penetration of rock fractures under the action of dynamic disturbances, and evaluating the fracture damage inside the surrounding rock induced by three-dimensional stress waves, and thus achieving long-term continuous monitoring of the fracture evolution process of the surrounding rock in risk regions.

To achieve the above objectives, the present invention provides the following technical solutions. A long-term monitoring apparatus for a surrounding rock fracture evolution process triggered by multiple-source dynamic disturbances is provided, including a machine body framework, a borehole wall surrounding rock image acquisition module, a borehole wall multiple-source vibration monitoring module, an in-borehole walking module, and a monitoring signal storage and transmission module, wherein the borehole wall surrounding rock image acquisition module is disposed at a foremost end of the machine body framework: the borehole wall multiple-source vibration monitoring module is disposed on the machine body framework behind the borehole wall surrounding rock image acquisition module: the in-borehole walking module is disposed on the machine body framework behind the borehole wall multiple-source vibration monitoring module; and the monitoring signal storage and transmission module is disposed at a rearmost end of the machine body framework and the monitoring signal storage and transmission module is connected to a computer outside a borehole via a cable or wireless network.

The borehole wall surrounding rock image acquisition module includes a 360° panoramic camera, a transparent protective cover, LED lights, and conical reflectors; wherein the 360° panoramic camera is disposed at a center of the transparent protective cover: the LED lights are located in the transparent protective cover and the LED lights are uniformly distributed along a circumferential direction of the 360° panoramic camera; and each LED light is provided with one conical reflector, and the LED light is disposed at a center of the conical reflector.

The borehole wall multiple-source vibration monitoring module includes a sensor lifting actuator and a triaxial vibration monitoring sensor assembly, wherein the sensor lifting actuator is disposed on the machine body framework, and the triaxial vibration monitoring sensor assembly is disposed on the sensor lifting actuator.

The sensor lifting actuator includes a first electric push rod, a first translation slide rod, a first connecting rod, a lifting support frame, a first lifting slide rod, and a second lifting slide rod, wherein the first electric push rod is horizontally fixed to a bottom portion of the machine body framework, a power output shaft end of the first electric push rod is hinged to a middle portion of the first translation slide rod, and the first translation slide rod is perpendicularly disposed relative to the first electric push rod: the machine body framework is provided with a horizontal slide groove; an end of the first translation slide rod is located in the horizontal slide groove and the first translation slide rod has a linear translation degree of freedom along the horizontal slide groove; the first connecting rod is a parallel double-rod structure, a lower end of the first connecting rod is hinged to the first translation slide rod, and an upper end of the first connecting rod is hinged to a middle portion of the lifting support frame: the lifting support frame is horizontally disposed, and the triaxial vibration monitoring sensor assembly is mounted above the lifting support frame: the first lifting slide rod is horizontally mounted at a front end of the lifting support frame, the second lifting slide rod is horizontally mounted at a rear end of the lifting support frame, and the first lifting slide rod, the second lifting slide rod, and the first translation slide rod are arranged in parallel: the machine body framework is provided with a first vertical slide groove and a second vertical slide groove; an end of the first lifting slide rod is located in the first vertical slide groove and the first lifting slide rod has a linear lifting degree of freedom along the first vertical slide groove; and an end of the second lifting slide rod is located in the second vertical slide groove and the second lifting slide rod has a linear lifting degree of freedom along the second vertical slide groove.

The triaxial vibration monitoring sensor assembly includes a triaxial acceleration sensor, an acoustic emission sensor, a temperature sensor, and a pulse sensor, where the triaxial acceleration sensor, the acoustic emission sensor, the temperature sensor, and the pulse sensor are integrated in a coupling housing.

The in-borehole walking module includes a lower walking motor, a lower walking wheel, a first upper walking motor, a first upper walking wheel, a second upper walking motor, a second upper walking wheel, and an upper walking wheel lifting actuator, wherein the lower walking motor is horizontally fixed to a bottom portion of the machine body framework, and the lower walking wheel is mounted on a motor shaft of the lower walking motor: the upper walking wheel lifting actuator is disposed above the machine body framework: the first upper walking motor and the second upper walking motor are arranged side by side on the upper walking wheel lifting actuator: the first upper walking wheel is mounted on a motor shaft of the first upper walking motor; the second upper walking wheel is mounted on a motor shaft of the second upper walking motor; and a first lower driven wheel is disposed at a front end of the machine body framework, and a second lower driven wheel is disposed at a rear end of the machine body framework.

The upper walking wheel lifting actuator includes a second electric push rod, a second translation slide rod, a horizontal slide rail, a second connecting rod, a first rocker, a second rocker, and a third connecting rod, wherein the second electric push rod is horizontally arranged above the machine body framework, a power output shaft of the second electric push rod is hinged to a middle portion of the second translation slide rod, and the second translation slide rod is perpendicularly disposed relative to the second electric push rod: the horizontal slide rail is a parallel double-rail structure, the horizontal slide rail is disposed on the machine body framework on two sides of the second electric push rod, an end of the second translation slide rod is located in the horizontal slide rail, and the second translation slide rod has a linear translation degree of freedom along the horizontal slide rail; the first rocker is a parallel double-rod structure, a lower end of the first rocker is hinged to the machine body framework, the first rocker is adjacent to the borehole wall multiple-source vibration monitoring module, and the first upper walking motor is fixedly mounted at an upper end of the first rocker, the second rocker is a parallel double-rod structure, a lower end of the second rocker is hinged to the machine body framework, the second rocker is adjacent to the monitoring signal storage and transmission module, and the second upper walking motor is fixedly mounted to an upper end of the second rocker: the second connecting rod is a parallel double-rod structure, a lower end of the second connecting rod is hinged to the middle portion of the second translation slide rod, and an upper end of the second connecting rod is hinged to a middle portion of the second rocker: the third connecting rod is a parallel double-rod structure, a front end of the third connecting rod is hinged to a middle portion of the first rocker, and a rear end of the third connecting rod is hinged to the middle portion of the second rocker; and the first rocker, the third connecting rod, the second rocker, and the machine body framework form a parallelogram mechanism.

A long-term monitoring method for a surrounding rock fracture evolution process triggered by multiple-source dynamic disturbances is provided, using the long-term monitoring apparatus for the surrounding rock fracture evolution process triggered by the multiple-source dynamic disturbances, the method including the following steps:

Step 1: placing the long-term monitoring apparatus for the surrounding rock fracture evolution process triggered by the multiple-source dynamic disturbances into a borehole, such that the lower walking wheel, the first lower driven wheel, and the second lower driven wheel contact a borehole wall of a surrounding rock:

Step 2: activating the upper walking wheel lifting actuator to bring the first upper walking wheel and the second upper walking wheel into contact with the borehole wall of the surrounding rock:

Step 3: setting a vibration monitoring point, a vibration monitoring duration, an abnormal vibration frequency, and an operation time interval of the borehole wall surrounding rock image acquisition module on the computer;

Step 4: activating the lower walking motor, the first upper walking motor, and the second upper walking motor, to drive the lower walking wheel, the first upper walking wheel, and the second upper walking wheel to rotate, thereby driving the long-term monitoring apparatus for the surrounding rock fracture evolution process triggered by the multiple-source dynamic disturbances to the vibration monitoring point:

Step 5: activating the sensor lifting actuator to lift the triaxial vibration monitoring sensor assembly upper, such that the triaxial vibration monitoring sensor assembly comes into contact with the borehole wall of the surrounding rock:

Step 6: activating the triaxial vibration monitoring sensor assembly to start vibration monitoring:

Step 7: after the vibration monitoring duration is reached, activating the sensor lifting actuator to decouple the triaxial vibration monitoring sensor assembly from the borehole wall of the surrounding rock until the triaxial vibration monitoring sensor assembly returns to an initial position:

Step 8: activating the lower walking motor, the first upper walking motor, and the second upper walking motor, to drive the lower walking wheel, the first upper walking wheel, and the second upper walking wheel to rotate, thereby driving the long-term monitoring apparatus for the surrounding rock fracture evolution process triggered by the multiple-source dynamic disturbances to a borehole opening:

Step 9: activating the borehole wall surrounding rock image acquisition module and controlling the long-term monitoring apparatus for the surrounding rock fracture evolution process triggered by the multiple-source dynamic disturbances to move from the borehole opening to a borehole bottom, where during movement, the borehole wall surrounding rock image acquisition module acquires a complete image of the borehole wall of the surrounding rock:

Step 10: after the complete image of the borehole wall of the surrounding rock is acquired, controlling the long-term monitoring apparatus for the surrounding rock fracture evolution process triggered by the multiple-source dynamic disturbances to return to the vibration monitoring point; and Step 11: repeating steps 5 to 10 to perform long-term continuous monitoring of the surrounding rock fracture evolution process.

BENEFICIAL EFFECTS OF THE PRESENT INVENTION

The long-term monitoring apparatus and method for the surrounding rock fracture evolution process triggered by the multiple-source dynamic disturbances provided by the present invention can achieve integrated monitoring of imaging and vibration within a borehole. During vibration monitoring, the coupling and decoupling of the sensor and the surrounding rock are realized through a mechanical lifting manner, so as to achieve the monitoring of the surrounding rock state before and after the dynamic disturbance waves. This is conducive to identifying the initiation, expansion, and penetration of rock fractures under the action of dynamic disturbances, and evaluating the fracture damage inside the surrounding rock induced by three-dimensional stress waves, and thus achieving long-term continuous monitoring of the fracture evolution process of the surrounding rock in risk regions.

BRIEF DESCRIPTION OF THE DRAWINGS

The sole FIGURE is a schematic structural diagram of a long-term monitoring apparatus for a surrounding rock fracture evolution process triggered by multiple-source dynamic disturbances according to the present invention.

In the drawing, 1: machine body framework; 2: borehole wall surrounding rock image acquisition module; 3: monitoring signal storage and transmission module; 4: cable: 5: triaxial vibration monitoring sensor assembly; 6: first electric push rod; 7: first translation slide rod; 8: first connecting rod; 9: lifting support frame; 10: first lifting slide rod; 11: second lifting slide rod; 12: horizontal slide groove; 13: first vertical slide groove; 14: second vertical slide groove; 15: lower walking motor; 16: lower walking wheel; 17: first upper walking motor; 18: first upper walking wheel; 19: second upper walking motor; 20: second upper walking wheel; 21: first lower driven wheel; 22: second lower driven wheel; 23: second electric push rod; 24: horizontal slide rail; 25: second connecting rod; 26: first rocker; 27: second rocker; and 28: third connecting rod.

DETAILED DESCRIPTION OF THE EMBODIMENTS

The present invention will be further described in detail below with reference to the accompanying drawings and specific embodiments. As shown in the sole FIGURE, a long-term monitoring apparatus for a surrounding rock fracture evolution process triggered by multiple-source dynamic disturbances is provided, including a machine body framework 1, a borehole wall surrounding rock image acquisition module 2, a borehole wall multiple-source vibration monitoring module, an in-borehole walking module, and a monitoring signal storage and transmission module 3. The borehole wall surrounding rock image acquisition module 2 is disposed at the foremost end of the machine body framework 1. The borehole wall multiple-source vibration monitoring module is disposed on the machine body framework 1 behind the borehole wall surrounding rock image acquisition module 2. The in-borehole walking module is disposed on the machine body framework 1 behind the borehole wall multiple-source vibration monitoring module. The monitoring signal storage and transmission module 3 is disposed at the rearmost end of the machine body framework 1, and the monitoring signal storage and transmission module 3 is connected to a computer outside the borehole via a cable 4 or a wireless network.

In this embodiment, the computer may be a laptop, desktop computer, tablet, smartphone, or the like. When the signal transmission method is wireless transmission, the computer may use short-range wireless transmission methods such as Bluetooth transmission or WiFi transmission, or long-range wireless transmission methods such as 4G or 5G networks, thereby achieving remote cross-regional monitoring on a cloud platform and allowing real-time viewing of vibration monitoring data and surrounding rock borehole wall fracture evolution images on the computer. Additionally, the computer can remotely control the traveling direction and traveling speed of the monitoring apparatus within the borehole, control the coupling and decoupling of the borehole wall multiple-source vibration monitoring module and the surrounding rock borehole wall, and also control the borehole wall surrounding rock image acquisition module 2 to acquire images of the borehole wall of the surrounding rock.

The borehole wall surrounding rock image acquisition module 2 includes a 360° panoramic camera, a transparent protective cover, LED lights, and conical reflectors. The 360° panoramic camera is disposed at a center of the transparent protective cover: the LED lights are located in the transparent protective cover and the LED lights are uniformly distributed along a circumferential direction of the 360° panoramic camera; and each LED light is provided with one conical reflector, and the LED light is disposed at a center of the conical reflector.

In this embodiment, the imaging resolution of the 360° panoramic camera is 1920×1080, the measurement accuracy of the 360° panoramic camera is 0.5%, and the distance measurement accuracy of the 360° panoramic camera is 0.001 meters.

The borehole wall multiple-source vibration monitoring module includes a sensor lifting actuator and a triaxial vibration monitoring sensor assembly 5. The sensor lifting actuator is disposed on the machine body framework 1, and the triaxial vibration monitoring sensor assembly 5 is disposed on the sensor lifting actuator.

The sensor lifting actuator includes a first electric push rod 6, a first translation slide rod 7, a first connecting rod 8, a lifting support frame 9, a first lifting slide rod 10, and a second lifting slide rod 11. The first electric push rod 6 is horizontally fixed to a bottom portion of the machine body framework 1, a power output shaft end of the first electric push rod 6 is hinged to a middle portion of the first translation slide rod 7, and the first translation slide rod 7 is perpendicularly disposed relative to the first electric push rod 6. The machine body framework 1 is provided with a horizontal slide groove 12. An end of the first translation slide rod 7 is located in the horizontal slide groove 12, and the first translation slide rod 7 has a linear translation degree of freedom along the horizontal slide groove 12. The first connecting rod 8 is a parallel double-rod structure, a lower end of the first connecting rod 8 is hinged to the first translation slide rod 7, and an upper end of the first connecting rod 8 is hinged to a middle portion of the lifting support frame 9. The lifting support frame 9 is horizontally disposed, and the triaxial vibration monitoring sensor assembly 5 is mounted above the lifting support frame 9. The first lifting slide rod 10 is horizontally mounted at a front end of the lifting support frame 9, the second lifting slide rod 11 is horizontally mounted at a rear end of the lifting support frame 9, and the first lifting slide rod 10, the second lifting slide rod 11, and the first translation slide rod 7 are arranged in parallel. The machine body framework 1 is provided with a first vertical slide groove 13 and a second vertical slide groove 14. An end of the first lifting slide rod 10 is located in the first vertical slide groove 13, and the first lifting slide rod 10 has a linear lifting degree of freedom along the first vertical slide groove 13. An end of the second lifting slide rod 11 is located in the second vertical slide groove 14, and the second lifting slide rod 11 has a linear lifting degree of freedom along the second vertical slide groove 14.

The working principle of the sensor lifting actuator is as follows: After the first electric push rod 6 is activated, its power output shaft can perform a linear telescopic motion. The power output shaft of the first electric push rod 6 can drive the first translation slide rod 7 to move back and forth along the horizontal slide groove 12. When the first translation slide rod 7 moves back and forth, it drives the lifting support frame 9 to move through the transmission of the first connecting rod 8. Since the first lifting slide rod 10 and the second lifting slide rod 11 are respectively located in the first vertical slide groove 13 and the second vertical slide groove 14, the first lifting slide rod 10 can only move vertically along the first vertical slide groove 13, and the second lifting slide rod 11 can only move vertically along the second vertical slide groove 14, thereby restricting the lifting support frame 9 to only move vertically along the first vertical slide groove 13 and the second vertical slide groove 14. The vertical lifting movement of the lifting support frame 9 can drive the triaxial vibration monitoring sensor assembly 5 thereon to move vertically, ultimately achieving the coupling and decoupling of the triaxial vibration monitoring sensor assembly 5 and the surrounding rock borehole wall.

The triaxial vibration monitoring sensor assembly 5 includes a triaxial acceleration sensor, an acoustic emission sensor, a temperature sensor, and a pulse sensor, where the triaxial acceleration sensor, the acoustic emission sensor, the temperature sensor, and the pulse sensor are integrated in a coupling housing.

In this embodiment, a vibration velocity collection range of the triaxial acceleration sensor is 0 to 40 cm/s, an acceleration collection range of the triaxial acceleration sensor is −20 g to 20 g, and a vibration frequency range of the triaxial acceleration sensor is 0 to 1 kHz. A sound signal collection frequency response of the acoustic emission sensor is 20 Hz to 20,000 Hz. A temperature collection range of the temperature sensor is −40° C. to 100° C. An impact pulse energy collection range of the pulse sensor is 40 dB to 110 dB, and an impact pulse collection peak value of the pulse sensor is 50 dB to 130 dB.

The in-borehole walking module includes a lower walking motor 15, a lower walking wheel 16, a first upper walking motor 17, a first upper walking wheel 18, a second upper walking motor 19, a second upper walking wheel 20, and an upper walking wheel lifting actuator. The lower walking motor 15 is horizontally fixed to a bottom portion of the machine body framework 1, and the lower walking wheel 16 is mounted on a motor shaft of the lower walking motor 15. The upper walking wheel lifting actuator is disposed above the machine body framework 1. The first upper walking motor 17 and the second upper walking motor 19 are arranged side by side on the upper walking wheel lifting actuator. The first upper walking wheel 18 is mounted on a motor shaft of the first upper walking motor 17. The second upper walking wheel 20 is mounted on a motor shaft of the second upper walking motor 19. A first lower driven wheel 21 is disposed at a front end of the machine body framework 1, and a second lower driven wheel 22 is disposed at a rear end of the machine body framework 1.

The working principle of the in-borehole walking module is as follows: After the lower walking motor 15 is activated, it can directly drive the lower walking wheel 16 to rotate. After the first upper walking motor 17 is activated, it can directly drive the first upper walking wheel 18 to rotate. After the second upper walking motor 19 is activated, it can directly drive the second upper walking wheel 20 to rotate. When the apparatus moves along the borehole, the first lower driven wheel 21 and the second lower driven wheel 22 can follow, thereby improving the stability during the movement of the apparatus.

The upper walking wheel lifting actuator includes a second electric push rod 23, a second translation slide rod, a horizontal slide rail 24, a second connecting rod 25, a first rocker 26, a second rocker 27, and a third connecting rod 28. The second electric push rod 23 is horizontally arranged above the machine body framework 1, a power output shaft of the second electric push rod 23 is hinged to a middle portion of the second translation slide rod, and the second translation slide rod is perpendicularly disposed relative to the second electric push rod 23. The horizontal slide rail 24 is a parallel double-rail structure, the horizontal slide rail 24 is disposed on the machine body framework 1 on two sides of the second electric push rod 23, an end of the second translation slide rod is located in the horizontal slide rail 24, and the second translation slide rod has a linear translation degree of freedom along the horizontal slide rail 24. The first rocker 26 is a parallel double-rod structure, a lower end of the first rocker 26 is hinged to the machine body framework 1, the first rocker 26 is adjacent to the borehole wall multiple-source vibration monitoring module, and the first upper walking motor 17 is fixedly mounted at an upper end of the first rocker 26. The second rocker 27 is a parallel double-rod structure, a lower end of the second rocker 27 is hinged to the machine body framework 1, the second rocker 27 is adjacent to the monitoring signal storage and transmission module 3, and the second upper walking motor 19 is fixedly mounted to an upper end of the second rocker 27. The second connecting rod 25 is a parallel double-rod structure, a lower end of the second connecting rod 25 is hinged to the middle portion of the second translation slide rod, and an upper end of the second connecting rod 25 is hinged to a middle portion of the second rocker 27. The third connecting rod 28 is a parallel double-rod structure, a front end of the third connecting rod 28 is hinged to a middle portion of the first rocker 26, and a rear end of the third connecting rod 28 is hinged to the middle portion of the second rocker 27. The first rocker 26, the third connecting rod 28, the second rocker 27, and the machine body framework I form a parallelogram mechanism.

The working principle of the upper walking wheel lifting actuator is as follows: After the second electric push rod 23 is activated, its power output shaft can perform a linear telescopic motion. The power output shaft of the second electric push rod 23 can drive the second translation slide rod to move back and forth along the horizontal slide rail 24.

When the second translation slide rod moves back and forth, it drives the second rocker 27 to pivot around the lower hinge point via the second connecting rod 25, driving the second upper walking motor 19 at the upper end of the second rocker 27 to move synchronously, thus achieving the lifting or lowering of the second upper walking motor 19 and the second upper walking wheel 20 thereon. At the same time, during the pivoting movement of the second rocker 27 around the lower hinge point, the third connecting rod 28 drives the first rocker 26 to pivot around the lower hinge point, driving the first upper walking motor 17 at the upper end of the first rocker 26 to move synchronously, thus achieving the lifting or lowering of the first upper walking motor 17 and the first upper walking wheel 18 thereon.

A long-term monitoring method for a surrounding rock fracture evolution process triggered by multiple-source dynamic disturbances is provided, using the long-term monitoring apparatus for the surrounding rock fracture evolution process triggered by the multiple-source dynamic disturbances, the method including the following steps:

Step 1: placing the long-term monitoring apparatus for the surrounding rock fracture evolution process triggered by the multiple-source dynamic disturbances into a borehole, such that the lower walking wheel 16, the first lower driven wheel 21, and the second lower driven wheel 22 contact a borehole wall of a surrounding rock.

Step 2: activating the upper walking wheel lifting actuator to bring the first upper walking wheel 18 and the second upper walking wheel 20 into contact with the borehole wall of the surrounding rock.

Step 3: setting a vibration monitoring point, a vibration monitoring duration, an abnormal vibration frequency, and an operation time interval of the borehole wall surrounding rock image acquisition module 2 on the computer.

Step 4: activating the lower walking motor 15, the first upper walking motor 17, and the second upper walking motor 19 to drive the lower walking wheel 16, the first upper walking wheel 18, and the second upper walking wheel 20 to rotate, thereby driving the long-term monitoring apparatus for the surrounding rock fracture evolution process triggered by the multiple-source dynamic disturbances to the vibration monitoring point.

Step 5: activating the sensor lifting actuator to lift the triaxial vibration monitoring sensor assembly 5 upper, such that the triaxial vibration monitoring sensor assembly 5 comes into contact with the borehole wall of the surrounding rock.

Step 6: activating the triaxial vibration monitoring sensor assembly 5 to start vibration monitoring.

Step 7: After the vibration monitoring duration is reached, activating the sensor lifting actuator to decouple the triaxial vibration monitoring sensor assembly 5 from the borehole wall of the surrounding rock until the triaxial vibration monitoring sensor assembly 5 returns to an initial position.

Step 8: activating the lower walking motor 15, the first upper walking motor 17, and the second upper walking motor 19, to drive the lower walking wheel 16, the first upper walking wheel 18, and the second upper walking wheel 20 to rotate, thereby driving the long-term monitoring apparatus for the surrounding rock fracture evolution process triggered by the multiple-source dynamic disturbances to a borehole opening.

Step 9: activating the borehole wall surrounding rock image acquisition module 2 and control the long-term monitoring apparatus for the surrounding rock fracture evolution process triggered by the multiple-source dynamic disturbances to move from the borehole opening to a borehole bottom, where during movement, the borehole wall surrounding rock image acquisition module 2 acquires a complete image of the borehole wall of the surrounding rock.

Step 10: After the complete image of the borehole wall of the surrounding rock is acquired, controlling the long-term monitoring apparatus for the surrounding rock fracture evolution process triggered by the multiple-source dynamic disturbances to return to the vibration monitoring point.

Step 11: repeating steps 5 to 10 to perform long-term continuous monitoring of the surrounding rock fracture evolution process.

The solutions in the embodiments are not intended to limit the scope of the present invention. Any equivalent implementations or modifications that do not depart from the spirit of the present invention are included within the scope of the present invention.

The invention claimed is:

1. A long-term monitoring apparatus for a surrounding rock fracture evolution process triggered by multiple-source dynamic disturbances, comprising a machine body framework, a borehole wall surrounding rock image acquisition module, a borehole wall multiple-source vibration monitoring module, an in-borehole walking module, and a monitoring signal storage and transmission module, wherein the borehole wall surrounding rock image acquisition module is disposed at a foremost end of the machine body framework; the borehole wall multiple-source vibration monitoring module is disposed on the machine body framework behind the borehole wall surrounding rock image acquisition module; the in-borehole walking module is disposed on the machine body framework behind the borehole wall multiple-source vibration monitoring module; and the monitoring signal storage and transmission module is disposed at a rearmost end of the machine body framework and the monitoring signal storage and transmission module is connected to a computer outside a borehole via a cable or wireless network;

wherein the borehole wall multiple-source vibration monitoring module comprises a sensor lifting actuator and a triaxial vibration monitoring sensor assembly, wherein the sensor lifting actuator is disposed on the machine body framework, and the triaxial vibration monitoring sensor assembly is disposed on the sensor lifting actuator;

wherein the sensor lifting actuator comprises a first electric push rod, a first translation slide rod, a first connecting rod, a lifting support frame, a first lifting slide rod, and a second lifting slide rod, wherein the first electric push rod is horizontally fixed to a bottom portion of the machine body framework, a power output shaft end of the first electric push rod is hinged to a middle portion of the first translation slide rod, and the first translation slide rod is perpendicularly disposed relative to the first electric push rod; the machine body framework is provided with a horizontal slide groove; an end of the first translation slide rod is located in the horizontal slide groove and the first translation slide rod has a linear translation degree of freedom along the horizontal slide groove; the first connecting rod is a parallel double-rod structure, a lower end of the first connecting rod is hinged to the first translation slide rod, and an upper end of the first connecting rod is hinged to a middle portion of the lifting support frame; the lifting support frame is horizontally disposed, and the triaxial vibration monitoring sensor assembly is mounted above the lifting support frame; the first lifting slide rod is horizontally mounted at a front end of the lifting support frame, the second lifting slide rod is horizontally mounted at a rear end of the lifting support frame, and the first lifting slide rod, the second lifting slide rod, and the first translation slide rod are arranged in parallel; the machine body framework is provided with a first vertical slide groove and a second vertical slide groove; an end of the first lifting slide rod is located in the first vertical slide groove and the first lifting slide rod has a linear lifting degree of freedom along the first vertical slide groove; and an end of the second lifting slide rod is located in the second vertical slide groove and the second lifting slide rod has a linear lifting degree of freedom along the second vertical slide groove;

wherein the in-borehole walking module comprises a lower walking motor, a lower walking wheel, a first upper walking motor, a first upper walking wheel, a second upper walking motor, a second upper walking wheel, and an upper walking wheel lifting actuator, wherein the lower walking motor is horizontally fixed to a bottom portion of the machine body framework, and the lower walking wheel is mounted on a motor shaft of the lower walking motor; the upper walking wheel lifting actuator is disposed above the machine body framework; the first upper walking motor and the second upper walking motor are arranged side by side on the upper walking wheel lifting actuator; the first upper walking wheel is mounted on a motor shaft of the first upper walking motor; the second upper walking wheel is mounted on a motor shaft of the second upper walking motor; and a first lower driven wheel is disposed at a front end of the machine body framework, and a second lower driven wheel is disposed at a rear end of the machine body framework;

wherein the upper walking wheel lifting actuator comprises a second electric push rod, a second translation slide rod, a horizontal slide rail, a second connecting rod, a first rocker, a second rocker, and a third connecting rod, wherein the second electric push rod is horizontally arranged above the machine body framework, a power output shaft of the second electric push rod is hinged to a middle portion of the second translation slide rod, and the second translation slide rod is perpendicularly disposed relative to the second electric push rod; the horizontal slide rail is a parallel double-rail structure, the horizontal slide rail is disposed on the machine body framework on two sides of the second electric push rod, an end of the second translation slide rod is located in the horizontal slide rail, and the second translation slide rod has a linear translation degree of freedom along the horizontal slide rail; the first rocker is a parallel double-rod structure, a lower end of the first rocker is hinged to the machine body framework, the first rocker is adjacent to the borehole wall multiple-source vibration monitoring module, and the first upper walking motor is fixedly mounted at an upper end of the first rocker, the second rocker is a parallel double-rod structure, a lower end of the second rocker is hinged to the machine body framework, the second rocker is adjacent to the monitoring signal storage and transmission module, and the second upper walking motor is fixedly mounted to an upper end of the second rocker; the second connecting rod is a parallel double-rod structure, a lower end of the second connecting rod is hinged to the middle portion of the second translation slide rod, and an upper end of the second connecting rod is hinged to a middle portion of the second rocker; the third connecting rod is a parallel double-rod structure, a front end of the third connecting rod is hinged to a middle portion of the first rocker, and a rear end of the third connecting rod is hinged to the middle portion of the second rocker; and the first rocker, the third connecting rod, the second rocker, and the machine body framework form a parallelogram mechanism.

2. The long-term monitoring apparatus for the surrounding rock fracture evolution process triggered by the multiple-source dynamic disturbances according to claim 1, wherein the borehole wall surrounding rock image acquisition module comprises a 360° panoramic camera, a transparent protective cover, LED lights, and conical reflectors; wherein the 360° panoramic camera is disposed at a center of the transparent protective cover; the LED lights are located in the transparent protective cover and the LED lights are uniformly distributed along a circumferential direction of the 360° panoramic camera; and each LED light is provided with one conical reflector, and the LED light is disposed at a center of the conical reflector.

3. The long-term monitoring apparatus for the surrounding rock fracture evolution process triggered by the multiple-source dynamic disturbances according to claim 1, wherein the triaxial vibration monitoring sensor assembly comprises a triaxial acceleration sensor, an acoustic emission sensor, a temperature sensor, and a pulse sensor, wherein the triaxial acceleration sensor, the acoustic emission sensor, the temperature sensor, and the pulse sensor are integrated in a coupling housing.

4. A long-term monitoring method for a surrounding rock fracture evolution process triggered by multiple-source dynamic disturbances, using the long-term monitoring apparatus for the surrounding rock fracture evolution process triggered by the multiple-source dynamic disturbances according to claim 1, the method comprising the following steps:

Step 1: placing the long-term monitoring apparatus for the surrounding rock fracture evolution process triggered by the multiple-source dynamic disturbances into a borehole, such that the lower walking wheel, the first lower driven wheel, and the second lower driven wheel contact a borehole wall of a surrounding rock;

Step 2: activating the upper walking wheel lifting actuator to bring the first upper walking wheel and the second upper walking wheel into contact with the borehole wall of the surrounding rock;

Step 3: setting a vibration monitoring point, a vibration monitoring duration, an abnormal vibration frequency, and an operation time interval of the borehole wall surrounding rock image acquisition module on the computer;

Step 4: activating the lower walking motor, the first upper walking motor, and the second upper walking motor, to drive the lower walking wheel, the first upper walking wheel, and the second upper walking wheel to rotate, thereby driving the long-term monitoring apparatus for the surrounding rock fracture evolution process triggered by the multiple-source dynamic disturbances to the vibration monitoring point;

Step 5: activating the sensor lifting actuator to lift the triaxial vibration monitoring sensor assembly upper, such that the triaxial vibration monitoring sensor assembly comes into contact with the borehole wall of the surrounding rock;

Step 6: activating the triaxial vibration monitoring sensor assembly to start vibration monitoring;

Step 7: after the vibration monitoring duration is reached, activating the sensor lifting actuator to decouple the triaxial vibration monitoring sensor assembly from the borehole wall of the surrounding rock until the triaxial vibration monitoring sensor assembly returns to an initial position;

Step 8: activating the lower walking motor, the first upper walking motor, and the second upper walking motor, to drive the lower walking wheel, the first upper walking wheel, and the second upper walking wheel to rotate, thereby driving the long-term monitoring apparatus for the surrounding rock fracture evolution process triggered by the multiple-source dynamic disturbances to a borehole opening;

Step 9: activating the borehole wall surrounding rock image acquisition module and controlling the long-term monitoring apparatus for the surrounding rock fracture evolution process triggered by the multiple-source dynamic disturbances to move from the borehole opening to a borehole bottom, wherein during movement, the borehole wall surrounding rock image acquisition module acquires a complete image of the borehole wall of the surrounding rock;

Step 10: after the complete image of the borehole wall of the surrounding rock is acquired, controlling the long-term monitoring apparatus for the surrounding rock fracture evolution process triggered by the multiple-source dynamic disturbances to return to the vibration monitoring point; and Step 11: repeating Steps 5 to 10 to perform long-term continuous monitoring of the surrounding rock fracture evolution process.

* * * * *